US005364473A

United States Patent [19]

Van Der Does

[11] Patent Number: 5,364,473

[45] Date of Patent: Nov. 15, 1994

[54] TREATMENT ELEMENT AND METHOD FOR TREATING THE INSIDE OF PIPES

[75] Inventor: Hendrik J. Van Der Does, Rheden, Netherlands

[73] Assignee: Milieu Diensten Combinatie B.V., Arnhem, Netherlands

[21] Appl. No.: 982,735

[22] PCT Filed: Aug. 29, 1991

[86] PCT No.: PCT/NL91/00160

§ 371 Date: Feb. 25, 1993

§ 102(e) Date: Feb. 25, 1993

[87] PCT Pub. No.: WO92/04136

PCT Pub. Date: Mar. 19, 1992

[30] Foreign Application Priority Data

Aug. 29, 1990 [NL] Netherlands ..... 9001894

[51] Int. Cl.[5] ..... B08B 9/04

[52] U.S. Cl. ..... 134/8; 134/22.11; 134/22.12; 134/23; 134/32; 15/104.061

[58] Field of Search ..... 134/22.11, 22.12, 21, 134/23, 32, 8; 15/104.061

[56] References Cited

U.S. PATENT DOCUMENTS

| | | | |
|---|---|---|---|
| 2,289,109 | 7/1942 | Edwards et al. | 15/104.061 |
| 2,481,152 | 9/1949 | Redmond | 15/104.061 |
| 2,508,659 | 5/1950 | Brown | 15/104.061 |
| 3,119,600 | 1/1964 | Bitter | 15/104.061 |
| 3,179,375 | 4/1965 | Hamrick | 15/104.061 |
| 3,879,790 | 4/1975 | Girard | 15/104.061 |
| 4,141,753 | 2/1979 | Creed | 134/8 |
| 4,337,096 | 6/1982 | Clifford | 134/24 X |
| 4,715,747 | 12/1987 | Behrens | 134/22.11 X |
| 5,069,722 | 12/1991 | Murphy | 134/22.12 X |

FOREIGN PATENT DOCUMENTS 0300602 1/1989 European Pat. Off. .

*Primary Examiner*—Richard O. Dean
*Assistant Examiner*—Saeed Chaudhry
*Attorney, Agent, or Firm*—Handal & Morofsky

[57] ABSTRACT

A treatment element is provided for treating the inside of pipes, which element is bulged out by a medium flow presence in the pipe (1), while the movement of the element through the pipe can be controlled by a flexible pulling element. This treatment element (2) comprises a radially free compressible bag, the edge (5) of the open edge (6) of which is connected to the flexible pulling element (4). A wall pan (3) running in the peripheral direction of the bag is pressed against the inner wall of the pipe by the thrust of the medium, through which the inner wall is treated.

13 Claims, 1 Drawing Sheet

TREATMENT ELEMENT AND METHOD FOR TREATING THE INSIDE OF PIPES

The present invention relates to a method for treating the inside of a pipe, and to a treatment element for carrying out such a method. Although the description which follows relates mainly to the cleaning of air conditioning ducts of the type known in air conditioning systems for buildings, it must be realised that the present invention is suitable for all kinds of pipes, for example gas pipes, oil pipes, pipes for conveying so-called bulk materials, and so on.

Various methods are known for treating the inside of a pipe. For example, so-called ragging, where a bristly element is moved through the pipe and brushes with the brush hairs along the inside wall of the pipe. In vertically disposed pipes gravity is used for moving the ragger. In horizontal running pipes the ragger is often designed in such a way that it can move on wheels through the pipe.

The known treatment methods are disadvantageous. For example, in a pipe not running vertically the propulsion of the treatment element requires special measures. This is one of the reasons why such a treatment element is generally heavy, is complex in design, is relatively large, is above all expensive, and is generally susceptible to breakdown. It also often occurs that the pipe is not cleaned properly at all points. This is caused, inter alia, because in many cases the cross-section of the pipe varies over the length thereof. These variations can take place stepwise. Obstacles such as guide vanes and the like are also often situated in the pipes. The most well-known treatment elements cannot adapt well or at all to the changing conditions inside the pipe, with the result that the quality of the treatment of the inside of the pipe varies. Due to the fact that most treatment methods have to be carried out with a relatively heavy treatment element, the treatment of relatively fragile or very small pipes is impossible, or at least very difficult. In particular, in the case of more or less uncompressed conveyance of gaseous media such as air, relatively fragile pipes with corresponding light supporting structures are in fact used. Such pipes are found in many large modern buildings, such as offices, hospitals, retirement homes etc. The overall length of these pipe systems is often considerable. Besides, the scale of shapes and dimensions of the cross-sections of such pipes is very extensive. The accessibility of these types of pipe systems is, however, often very poor, and they are often not provided at all with access gates or inspection doors.

In addition to the disadvantages of the known treatment methods already mentioned above, the discharge of loosened dirt is, for example, a problem when cleaning the inside of a pipe.

The object of the present invention is to solve the above-mentioned problems satisfactorily. To this end, the invention provides a method for treating the inside of a pipe, in particular of a pipe for the transportation of compressible media such as air, which method is characterised in that a flow of a compressible medium is generated in the pipe and in that, while a compressible medium is flowing through the pipe a treatment element is moved in the lengthwise direction through the pipe under the influence of the thrust of the medium against said element. The movement of the treatment element is in this case controlled by a flexible pulling element, and through the thrust of the medium against the treatment element a flexible wall part of the treatment element running in the peripheral direction is pressed against the wall of the pipe.

Due to the fact that a compressible medium is flowing through the duct, the dirt or other material loosened during the treatment is automatically discharged to the downstream end of the pipe. Due to the fact that use is made of a wall part of the treatment element running in the peripheral direction which is pressed against the wall of the pipe, contact between the treatment element and the wall of the pipe is ensured at all points of the pipe. The treatment element can be controlled or slowed down by means of the flexible pulling element in such a way that it moves with the medium flow in the pipe, or moves in the opposite direction to it, or stands still.

In a preferred embodiment of the present invention the method is characterised in that the direction of flow of the medium during the treatment is opposite to the usual direction of flow. This gives advantages particularly in the case of pipes which open out into a large room. This is the case with, for example, ventilation shafts in buildings through which fresh air flows to the different living rooms. Directing the flow in the opposite direction during the carrying out of the method ensures that the material which has come away during the treatment does not flow into the living rooms.

It is preferable if the pipe forms part of an air conditioning system for buildings that an end of the pipe is already or is now connected to the suction side of an air conditioning cabinet or of a mobile fan unit. If the pipe in normal circumstances is already being used for the suction of air out of the living rooms, this is automatically the case. If this is not the case, there is still a possibility of using the air conditioning cabinet already present, in which case then the flow of the medium during the treatment must be directed in the opposite direction to the usual direction of flow.

It can also be an advantage while the process is being carried out to have the air treatment cabinet to which the pipe to be treated is connected blown out in an essentially closed space in which the air conditioning cabinet is situated. In that case the material carried along with the medium flow is collected in said space. After the completion of the treatment, this generally fairly readily accessible space can be cleaned.

Controlling of the movement of the treatment element in the pipe by means of a flexible pulling element can be carried out by fixing a bracket with a flexible guide means on or in an aperture which can be shut off in the wall of the pipe. This can be carried out in such a way that it can, inter alia, be ensured that the flexible pulling element is held well in the centre of the duct, and that it is thus ensured that the flexible pulling element is not severed through contact with a sharp edge of the generally very thin sheet material of the pipe wall near the edge of the aperture in the pipe.

It is advantageous in the case of the method described above to use a treatment element which is characterised in that it has a bag which at least over a part of its length and near the open end is to some extent flexible for radial compression, with along a part of its length an outer surface of at least approximately constant cross-section over the length which treats the inside wall of the pipe. The edge of the open end is connected to the flexible pulling element. If this treatment element is held in the medium flow, it will bulge out due to the thrust produced. If the dimensions of the bag are great enough, a wall part of the flexible bag running in the peripheral direction will be pressed against the wall of the pipe. Since the bag is flexible for radial compression, it can easily adapt within certain limits to cross-section changes of the pipe. Such cross-section changes can be caused by, for example, flanges projecting into the pipe, and they also occur when there are cross-section reductions at branches, which are necessary for maintaining the pressure.

For, for example, cleaning of the inside of the pipe it is preferable for the treating outside surface of the treatment element to be covered with an abrasive.

It is preferable that the bag of the treatment element, in the part situated past the treating outside surface, should merge into a part of reducing cross-section, ending in an aperture for allowing through the medium. In this way the treatment element will be flowed through by the medium, while the medium thrust is caused through the inlet aperture of the treatment element being greater than the outlet aperture.

In order to be able to vary the ratio between the inflow aperture and the outflow aperture of the treatment element depending on the conditions, it is preferable for the treatment element to be provided in the vicinity of the outflow aperture with means for varying the cross-section of said aperture.

It is also possible to cause a thrust of medium in an alternative manner. This is preferably achieved by fitting a flow element inside the bag of the treatment element.

The invention will be explained in greater detail with reference the drawings, which show a number of non-limiting examples of embodiments. In the drawings:

FIG. 1 shows a partially cut-away pipe with a treatment element according to the present invention disposed therein, in perspective view;

FIG. 2 shows a preferred embodiment of the treatment element according to the present invention, in perspective view;

FIG. 3 shows another preferred embodiment of the treatment element according to the present invention, in perspective view;

FIG. 4 shows an alternative embodiment of the treatment element according to the present invention, in perspective view;

FIG. 5 shows a view in cross-section of the pipe 1 at the position where the flexible pulling element is passed through.

Figures 1, 2, 3, 4, 5:
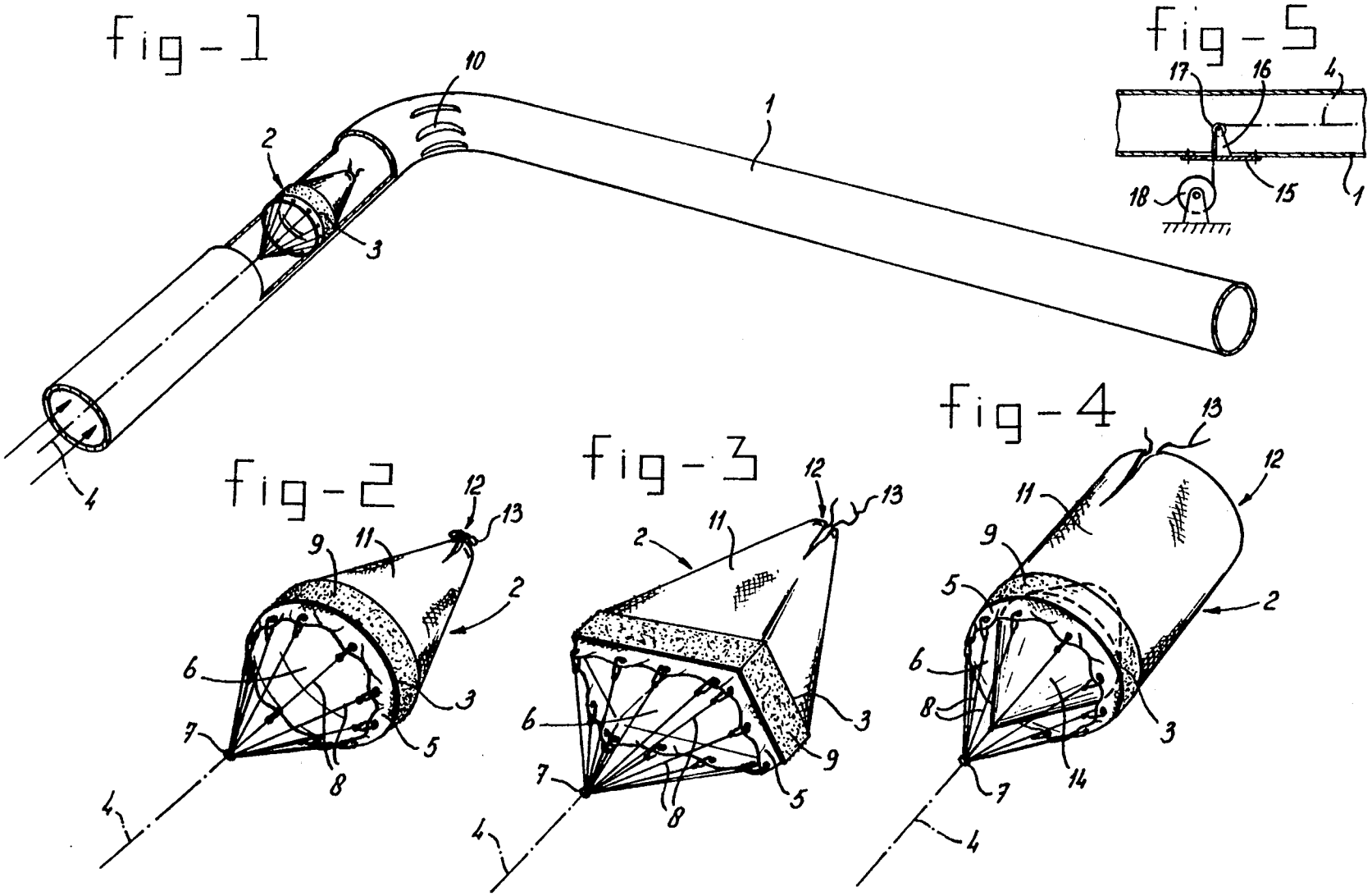

FIG. 1 shows a part of a pipe, for example a ventilation duct of an air conditioning system for buildings. Such pipes are generally designed in a light construction, and the support of such pipes is generally not designed for a higher load than purely the weight of the pipe itself. In addition, such pipes generally have poor accessibility, and during the original installation are hardly provided with access hatches or inspection doors. It is therefore generally necessary for access doors to be fitted first in such a pipe 1 of an air conditioning system before the treatment of the inside can be started. Due to the fact that with the present invention the pipe can be treated without disruption over a long length from one access aperture, the costs of providing the necessary access doors remain limited. A medium flows through the pipe part 1 in the direction of the arrows.

In the cut-away section of the pipe part 1 is a treatment element 2 for carrying out the method according to the present invention. The medium flowing through the pipe part 1 thrusts on the inside against the treatment element 2, as a result of which a flexible wall part 3 of the treatment element 2 running in the peripheral direction is pressed outwards against the wall of the pipe 1. The treatment element 2 is connected to a flexible pulling element 4, which is shown in all figures by a dashed and dotted line. It runs at a suitable point through an access aperture through which treatment element 2 can be inserted to the outside, and can be paid out and hauled in there with a reel. A solution to prevent the flexible pulling element from being severed by the generally sharp edges of such an access aperture is shown in FIG. 5. A bracket 16 is fitted projecting inwards into the inside of the pipe 1. For this, the bracket 16 is fixed on a cover plate 15 which is fixed along or on the edge of the aperture in the pipe 1. A guide wheel 17 over which the flexible pulling element 4 can be guided is fitted on the end of the bracket 16. This pulling element 4 runs from a pulley 18 outside the pipe 1 in the manner shown through the cover plate 15 and into the pipe 1. It is preferable for the measurement of the bracket 16 and the guide wheel 17 to be such that the flexible pulling element 4 in the tensioned state runs approximately in the centre point of the cross-section of the pipe 1. Through paying out or hauling in the flexible pulling element 4 it is possible to make the treatment element 2 move along with the medium stream in the direction of the arrows in FIG. 1, to stop it, or to make it move in the opposite direction to the direction of flow of the medium. In this process it will generally have to be ensured that the velocity difference between the treatment element 2 and the medium present upstream of the treatment element 2 is prevented from being zero. If this is prevented, the wall part 3 of the treatment element 2 will be pressed against the wall of the pipe in all circumstances. Due to the abrasive action thereof on the wall of the pipe 1, said wall can, for example, be cleaned and have the dust, dirt and the like present removed.

So-called guide vanes 10 are also often situated in bends in such a pipe 1. In the pipe shown they are achieved by means of depressions provided in the wall of the pipe 1. If for the method according to the present invention use is made of treatment elements such as those shown, for example, in FIGS. 2 and 3, it is now even possible for the treatment element, due to its flexibility, to pass through an opening between two of such guide vanes 10 and then to resume its former shape and continue its passage through pipe 1.

FIG. 2 shows a preferred embodiment of the treatment element 2 for carrying out the method according to the present invention. This preferred embodiment is formed by a slightly flexible bag with along a part of its length an outer surface 3 treating the inside wall of the pipe. The bag is connected to the edge 5 of the open end 6 by a flexible pulling element 4. Relatively short pulling elements are fixed at regular intervals to the edge 5 of the open end 6 along the periphery of the opening 6, these short pulling elements merging at their other end into a point 7 where they are fixed to the flexible pulling element 4. The fixing to the edge 5 of the open end 6 of these relatively short pulling elements 8 can be made detachable, for example by means of snap hooks which are fixed on the short flexible pulling elements 8 and are fastened to pull rings fitted in the edge 5 of the open end 6. The bag of the treatment element 2 shown in FIG. 2 is flexible for radial compression at least over part of its length and in any case near the open end 6. The bag is provided along a part of its length with an outer surface 3 treating the inside wall of the duct and being of at least approximately constant cross-section over the length, which outer surface 3 in the example shown is provided with an abrasive material 9. This can be, for example, material of the type used in the home for cleaning dishes or pans. Such an abrasive surface gives good results for cleaning off dust, dirt and the like from the inside of a pipe. Past the treating outside surface 3 the bag merges into a part 11 of reducing cross-section, ending in an aperture 12, the purpose of which is to allow through the medium. The shape shown means that the bag of the treatment element 2 will bulge out when it is flowed through by medium passing from inflow aperture 6 to outflow aperture 12. Along the edge of outflow aperture 12 a cord 13 is sewn into the edge of the outflow aperture, which makes it possible, through adjusting the cord 13 so that it is tighter or looser, to increase or reduce the cross-section of the outflow aperture 12. The treatment element 2 can also be used for carrying out the method according to the present invention if the outflow aperture 12 is completely shut off or is omitted, but the use of such an aperture is preferred.

FIG. 3 shows a different embodiment of the treatment element 2 for carrying out the method according to the present invention. In this case the periphery of the bag of the treatment element 2 is adapted to a pipe 1 with rectangular cross-section, instead of with a circular cross-section as was the case in the preceding example. For the rest, the treatment element has the same parts as the treatment element of FIG. 2. This means that a treatment element 2 adapted to the specific pipe can be manufactured cheaply for any type, any modified shape and any measurement of pipe 1.

With the embodiments shown in FIG. 2 and FIG. 3 of the treatment element 2 for carrying out the method according to the present invention it is possible for a treatment element 2 to be made totally flexible, so that it is easily possible to pass places with great cross-section changes in the pipe 1, such as at the position of the guide vanes 10.

FIG. 4 shows an alternative embodiment of the treatment element 2, which is not completely flexible. A shape-retaining flow element 14 now projects into the inflow aperture 6 of the bag. This flow element 14 is also attached in the manner shown to the flexible pulling element 4, as a result of which the flow element 14 cannot move in the lengthwise direction relative to the outer surface 3 treating the pipe 1. As shown, the flow element 14 has a conical front side and an aerodynamically shaped rear side. The part 11 of the treatment element 2 situated past the treating outer surface 3 in this embodiment does not have a reducing cross-section. This part does end in an aperture 12. The flow element 14 in the treatment element 2 will now give the desired thrust effect, so that the treating outer surface 3 will be pressed against the wall of the pipe 1. For additional thrust the cross-section of the aperture 12 can still be reduced by means of the cord 13. It is also possible to make an embodiment of the treatment element 2 as shown in FIG. 4 without flow element 14. The outflow aperture 12 will then always have to be made smaller than the inflow aperture 6 by means of the cord 13, or any other suitable means. The manufacture of such a treatment element is now even further simplified, through the fact that only two opposite edges of, for example, a rectangular piece of cloth need be fastened to each other, thus producing a sleeve-shaped element to which only cord 13, treatment surface 9 and, for example, along the edge 5 of the opening 6 pull eyes need be fastened.

Of course, other embodiments of the treatment element 2 are also possible. For example, other forms can be chosen for the flow element 14. The method of fastening the treatment element 2 to the flexible pulling element 4 can also be carried out in a different way. In addition, in the case of treatment elements for pipes with a circular cross-section it is possible to fit, for example, fins which are exposed to the flowing medium and are disposed in such a way that they set the treatment element 2 in rotation. This could produce an additional treating action. It could also be beneficial to make the edge of the aperture 12 elastically stretchable, for example by using an elastically stretchable cord 13, so that the ratio between the size of the inflow aperture 6 and the outflow aperture 12 of the treatment element 2 can automatically adapt within certain limits to changes occurring in the flow pattern. The present invention can, of course, also be very serviceable for treatments such as cleaning, coating, painting or covering the inside of, for example, an oil pipeline. It will then, of course, be necessary to remove the oil from the oil pipeline and temporarily create a flow of a compressible medium therein. Gas pipelines and all kinds of other pipes can be treated easily and effectively in this way. The desired flow of compressible medium can be generated by an external generator for a medium flow, for example a fan or a compressor. In the case of air conditioning systems for buildings, so-called air conditioning cabinets are, however, always present. These can be ideal for carrying out the method according to the invention. It is always best in this case when treating the pipe to use these air conditioning cabinets in such a way that air is sucked out of the various living rooms through the ducts to be treated. In some cases the direction of the air flow in the ducts to be treated has to be reversed for this purpose. This is possible in virtually all cases by the temporary use of flexible shunt pipes or bypass pipes which are fitted in such a way that the suction side of the existing air conditioning cabinet extracts from the pipe to be treated at that moment. If different air conditioning cabinets are present in the same location or in the same room, it is preferable for this solution to connect the pipe to be treated to the air conditioning cabinet with the largest capacity. It is also an advantage to use the space in which the air conditioning cabinets are situated for collecting the material removed from the pipes. This space is then simple to clean later.

I claim:

1. A collapsible, foldable, pipeline treatment element for treatment of an airflow pipeline, said airflow pipeline having an inner wall with an internal cross-section and a restricted-access aperture through which said treatment element is insertable into said pipeline, said treatment element comprising:

a) a flexible bag having front and rear ends with a front opening at said front end and shaped with an outer periphery engageable with said pipeline inner wall said outer periphery being surface textured to abrade said pipeline inner wall;

b) a group of flexible pulling elements connected to said flexible bag at regular intervals around said front opening and meeting one another at a fixed position in front of said flexible bag;

wherein said outer periphery is provided by a lengthwise extending portion of said bag, said bag having a constant cross-section throughout said lengthwise extending portion, said constant cross section of said bag corresponding with said internal cross-section of said airflow pipeline whereby said outer periphery is engageable with said pipeline inner wall continuously around said inner wall.

2. A pipeline treatment element according to claim 1 having an airflow control opening at said rear end and wherein said bag tapers rearwardly between said outer peripery and said airflow control opening.

3. A pipeline treatment element according to claim 2 wherein said bag is provided with airflow control means to vary the size of said airflow control opening.

4. A pipeline treatment element according to claim 1 comprising a shape-retaining flow element situated in the bag.

5. A pipeline treatment element according to claim 4 wherein said shape-retaining flow element is fixed relative to said outer periphery and has a conical forward side and an aerodynamically shaped rearward side.

6. A pipeline treatment element according to claim 1 wherein said bag comprises a flexible edge around said front opening of said bag, said flexible edge tapering forwardly of said bag, said flexible pulling elements being connected to said bag at said edge whereby flexible pulling elements are held clear of said inner pipeline wall during treatment.

7. A pipeline treatment element according to claim 1 wherein said pipeline and bag cross-sections are rectangular.

8. A method for treating an inner wall of a constant section, air conditioning pipeline in an air conditioning system comprising a blower for circulating air through said pipeline in a first direction of normal operation toward a space to be air conditioned, said method comprising:

i) connecting said blower to circulate air through said pipeline in a reversed direction opposite to said first direction and away from said space to be air conditioned;

ii) inserting a collapsible, foldable, pipeline treatment element through a restricted-access aperture into said air conditioning system;

iii) restraining said pipeline treatment element in said pipeline against said reversed direction airflow by means of a flexible treatment control line attached to said pipeline treatment element; and iv) positioning said pipeline treatment element along said pipeline by acting on said flexible treatment control line;

wherein said pipeline treatment element comprises:

v) a flexible bag having front and rear ends with a front opening at said front end and shaped with an outer periphery engageable with said pipeline inner wall, said outer periphery being surface textured to abrade said pipeline inner wall;

vi) a group of flexible pulling elements connected to said flexible bag at regular intervals around said front opening and meeting one another at a fixed position in front of said flexible bag for attachment to said treatment control line;

whereby said reversed airflow inflates said flexible bag and said outer periphery is pressed into engagement with said pipeline inner wall around said bag to effect treatment of said inner wall under control of said treatment control line.

9. A method according to claim 8 wherein said step iv) comprises paying out said flexible bag to allow said flexible bag to move with said airflow and hauling in said flexible line to move said flexible bag along said pipeline inner wall in a direction opposite to said reversed airflow direction.

10. A method according to claim 8 wherein said airflow pipeline has an interior wall of constant cross-section and said outer periphery is provided by a lengthwise extending portion of said bag, said bag having a constant cross-section throughout said lengthwise extending portion, said constant cross section of said bag corresponding with said internal cross-section of said airflow pipeline.

11. A method according to claim 8 wherein said pipeline contains obstructions and said treatment element collapses to pass said obstructions.

12. A method according to claim 8 including collecting dislodged dust and dirt centrally in the vicinity of said blower.

13. A method of cleaning interior wall surfaces of a pipeline, said method employing a treatment element having the form of a parachute connected to a rope, said method comprising:

a) connecting said parachute to said rope;

b) inserting said parachute into said pipeline;

c) providing an airflow in said pipeline;

d) expanding said parachute; and e) moving said parachute back and forth along said pipeline by lengthening and shortening of said rope, said lengthening and shortening being effected by acting on a rope end projecting externally of said pipeline;

whereby said parachute is inflated to engage said pipeline interior wall surfaces and clean them and wherein said parachute has a lengthwise extending portion carrying an outer periphery engageable with said pipeline inner wall, said parachute having a constant cross-section throughout said lengthwise extending portion, said constant cross section of said parachute corresponding with said internal cross-section of said airflow pipeline, wherein said outer periphery is surface textured to abrade said pipeline inner wall.

* * * * *